US010207905B2

(12) United States Patent
Breard et al.

(10) Patent No.: US 10,207,905 B2
(45) Date of Patent: Feb. 19, 2019

(54) CONTROL SYSTEM FOR WINCH AND CAPSTAN

(71) Applicant: Schlumberger Technology Corporation, Sugar Land, TX (US)

(72) Inventors: Stephane Michel Breard, Oust-Marest (FR); Stephane Georget, Caours (FR); Aurelien Delanez, Machy (FR)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 303 days.

(21) Appl. No.: 15/015,006

(22) Filed: Feb. 3, 2016

(65) Prior Publication Data

US 2016/0229672 A1 Aug. 11, 2016

(30) Foreign Application Priority Data

Feb. 5, 2015 (EP) ..... 15290027

(51) Int. Cl.

| | |
|---|---|
| ***B66D 1/50*** | (2006.01) |
| ***B66D 1/08*** | (2006.01) |
| ***B66D 1/76*** | (2006.01) |
| ***E21B 19/02*** | (2006.01) |

(52) U.S. Cl.

CPC ..... *B66D 1/505* (2013.01); *B66D 1/08* (2013.01); *B66D 1/76* (2013.01); *E21B 19/02* (2013.01)

(58) Field of Classification Search

CPC . B66D 1/08; B66D 1/50; B66D 1/505; B66D 1/7405; B66D 1/7447

See application file for complete search history.

(56) References Cited

U.S. PATENT DOCUMENTS

| | | | |
|---|---|---|---|
| 3,462,125 | A | 8/1969 | Gollwitzer et al. |
| 3,596,070 | A | 7/1971 | McCool et al. |
| 3,667,227 | A | 6/1972 | Bentkowsky et al. |
| 3,679,180 | A | 7/1972 | Callaghan |
| 3,774,883 | A | 11/1973 | Ostrom |
| 3,776,518 | A | 12/1973 | Witwer |
| 3,801,071 | A | 4/1974 | Barron |
| 3,838,846 | A | 10/1974 | Ostrom |
| 3,893,404 | A | 7/1975 | Chandler et al. |

(Continued)

FOREIGN PATENT DOCUMENTS

| | | | |
|---|---|---|---|
| WO | 2005090226 | A1 | 9/2005 |
| WO | 2007136378 | A1 | 11/2007 |
| WO | 2013022430 | A1 | 2/2013 |

OTHER PUBLICATIONS

Search and Examination Report issued in related GB application GB1601985.3 dated Sep. 1, 2016, 8 pages.

*Primary Examiner* — Emmanuel M Marcelo
(74) *Attorney, Agent, or Firm* — Eileen Pape

(57) ABSTRACT

A winch controller for a hoisting apparatus for a wireline operation operates as a closed loop controller. The winch controller is adapted to control a winch or, if included, a winch and a capstan in a coordinated manner. The winch controller may utilize process variables including the tension of the cable between the winch and the capstan. The controller is coupled to a power pack adapted to power the winch and capstan. The power pack and controller are configured such that the capstan may be selectively removed from the system when it is not needed.

18 Claims, 4 Drawing Sheets

(56) References Cited

U.S. PATENT DOCUMENTS 4,004,779 A 1/1977 Flesburg
4,034,963 A 7/1977 Warman et al.
4,042,215 A 8/1977 Hakes
4,048,799 A 9/1977 Golan et al.
4,067,546 A 1/1978 Matsuda et al.
4,088,304 A 5/1978 Gradert
4,095,424 A 6/1978 Laky
4,179,233 A 12/1979 Bromell et al.
4,185,520 A 1/1980 Henneman et al.
4,200,052 A 4/1980 Cunningham et al.
4,275,870 A 6/1981 Henneman et al.
4,305,513 A 12/1981 Voelz
4,312,497 A 1/1982 Whaley
4,318,533 A 3/1982 Port
4,337,926 A 7/1982 Dehaan
4,358,088 A 11/1982 House et al.
4,370,856 A 2/1983 Ito et al.
4,434,972 A 3/1984 Charles
4,440,041 A 4/1984 Bendtsen
4,441,448 A 4/1984 Hillberg
4,448,395 A 5/1984 Purdy
4,448,396 A 5/1984 Delago
4,448,398 A 5/1984 Wyatt
4,484,628 A 11/1984 Lanmon, II
4,485,870 A 12/1984 Walulik
4,516,755 A 5/1985 Uchimura
4,555,092 A 11/1985 Overholt
4,556,199 A 12/1985 Dansie et al.
4,570,245 A * 2/1986 Thigpen ..... B63B 21/56 254/274
4,577,693 A 3/1986 Graser
4,704,854 A 11/1987 Williams
4,750,430 A 6/1988 Morton et al.
4,828,430 A 5/1989 van der Heyden
5,019,978 A 5/1991 Howard, Jr. et al.
5,102,102 A 4/1992 Hidaka et al.
5,190,107 A 3/1993 Langner et al.
5,381,909 A 1/1995 Warnan
5,392,935 A 2/1995 Kazama et al.
5,435,351 A 7/1995 Head
5,503,370 A 4/1996 Newman et al.
5,573,225 A 11/1996 Boyle et al.
5,599,004 A 2/1997 Newman et al.
5,699,996 A 12/1997 Boyle et al.
5,732,835 A 3/1998 Morita et al.
5,803,008 A 9/1998 Georgens et al.
5,938,052 A 8/1999 Miyano et al.
5,970,906 A 10/1999 Hrescak et al.
6,086,050 A 7/2000 Wiederkehr et al.
6,151,774 A 11/2000 Nold, III
6,216,789 B1 4/2001 Lorsignol et al.
6,247,534 B1 6/2001 Newman
6,297,610 B1 10/2001 Bauer et al.
6,316,847 B1 11/2001 Crockett
6,367,778 B1 4/2002 Mobley et al.
6,398,189 B1 6/2002 Delaney et al.
6,420,802 B1 7/2002 Einhorn et al.
6,439,147 B2 8/2002 Cottrell et al.
6,439,407 B1 8/2002 Jacoff et al.
6,453,239 B1 9/2002 Shirasaka et al.
6,481,461 B1 11/2002 Habermann et al.
6,571,553 B1 6/2003 Habermann et al.
6,607,182 B1 8/2003 Turco et al.
6,618,675 B2 9/2003 Strickland
6,644,486 B2 11/2003 Jacoff et al.
6,991,161 B2 1/2006 Pazniokas et al.
7,063,306 B2 6/2006 Sanders et al.
7,152,685 B2 12/2006 Adnan et al.
7,166,061 B2 1/2007 Shimomura et al.
7,185,881 B2 3/2007 Drarvik et al.
7,201,366 B2 4/2007 Sanders et al.
7,261,277 B2 8/2007 Copeman
7,261,278 B2 8/2007 Ball et al.
7,296,527 B2 11/2007 Toth
7,415,936 B2 8/2008 Storteig et al.
7,416,169 B2 8/2008 Noeske et al.
7,465,876 B2 12/2008 Varkey
7,478,984 B2 1/2009 Hofius
7,500,651 B2 3/2009 Wentworth et al.
7,516,613 B2 4/2009 Kadlicko
7,523,835 B2 4/2009 Andersson
7,562,837 B2 7/2009 Brand et al.
7,581,715 B2 9/2009 Ball et al.
7,614,463 B1 11/2009 Hunziker
7,617,873 B2 11/2009 Lovell et al.
7,671,547 B2 3/2010 Addleman
7,690,430 B1 4/2010 Hunziker
7,708,072 B1 5/2010 Hunziker
7,780,145 B2 8/2010 Julien
7,788,920 B2 9/2010 Keast
7,793,409 B2 9/2010 Varkey
7,798,471 B2 9/2010 Christopher
7,822,802 B2 10/2010 Chen et al.
7,845,419 B2 12/2010 Naumann
7,856,817 B2 12/2010 Kadlicko
7,874,372 B2 1/2011 Varkey et al.
7,900,893 B2 3/2011 Teurlay et al.
7,909,308 B2 3/2011 Lauder et al.
7,921,879 B2 4/2011 Eschweiler
7,934,548 B2 5/2011 Doud et al.
8,020,667 B2 9/2011 Johnson
8,021,080 B2 9/2011 Frivik et al.
8,094,407 B2 1/2012 Cherubini et al.
8,099,196 B2 1/2012 Keintzel et al.
8,265,811 B2 9/2012 Kyllingstad
8,413,723 B2 4/2013 Varkey et al.
8,453,732 B2 6/2013 Sonne et al.
8,496,230 B1 7/2013 Jiron
8,602,394 B2 12/2013 Christiansen
8,602,688 B2 12/2013 Hansen et al.
8,613,310 B2 12/2013 Denoix et al.
8,738,259 B2 5/2014 Kosaka
8,752,618 B2 6/2014 Pose
2005/0279976 A1* 12/2005 Kohlenberg ..... B66C 13/16 254/274
2009/0127525 A1* 5/2009 Teurlay ..... B66D 1/505 254/274
2010/0137772 A1* 6/2010 Tanaka ..... B66D 1/38 602/33
2010/0147510 A1 6/2010 Kwok et al.
2010/0147588 A1 6/2010 Terry et al.
2012/0152530 A1 6/2012 Wiedecke et al.
2014/0048286 A1 2/2014 Rojas et al.
2014/0199152 A1* 7/2014 Roodenburg ..... B66D 1/7405 414/800
2014/0248089 A1* 9/2014 Thompson ..... H02G 1/04 405/184.3
2016/0031685 A1* 2/2016 Lawson ..... B66D 1/30 414/800
2016/0060083 A1* 3/2016 Klinke ..... B63B 27/08 414/800
2016/0114862 A1* 4/2016 Janik ..... B63B 21/50 701/21

* cited by examiner

CONTROL SYSTEM FOR WINCH AND CAPSTAN

CROSS-REFERENCE TO RELATED APPLICATIONS

This application claims benefit of and priority to European Patent Application No. 15290027.0, filed on Feb. 5, 2015, and entitled "Control System for Winch and Capstan." The entirety of the foregoing application is incorporated herein by reference.

TECHNICAL FIELD/FIELD OF THE DISCLOSURE

The present disclosure relates generally to motor control.

BACKGROUND OF THE DISCLOSURE

In a well intervention, one or more tools may be lowered into a wellbore. Tools may be placed into the wellbore by a variety of mechanisms. In wireline well intervention operations, a tool is lowered into the wellbore on a wire or cable which may include one or more electrical conductors. Typically, the wire is coupled to a winch at the surface. As understood in the art, a winch includes a drum around which the wire is wound. As the drum is rotated, the wire is extended or retracted (paid out or paid in respectively) depending on the direction of rotation of the drum. The position of the tool may thus be varied by operation of the winch.

In some operations in which the cable is to be put under higher tension, a capstan may be coupled to the cable between the winch and the wellbore. As understood in the art, a capstan or windlass includes one or more powered pulleys around which the wire may be at least partially wound. The capstan serves to apply force to the cable while reducing the tension at which it is wound onto or unwound from the winch. Thus, the capstan controls the position of the cable, while the winch follows the capstan to keep the cable wound on its drum.

In an operation utilizing a winch and capstan, the rotation of the winch and capstan are typically coordinated. A movement of the capstan without a coordinating movement of the winch may cause a decrease or increase in tension on the cable therebetween. A decrease in tension may allow the cable to slack and bow, possibly allowing the cable to slip through the capstan. On the other hand, an increase in tension may cause a rapid movement of the cable or the cable to break entirely, both situations being dangerous to equipment and personnel nearby.

SUMMARY

The present disclosure provides for a hoisting apparatus. The hoisting apparatus may include a winch. The winch may include a drum adapted to extend or retract a cable wrapped therearound. The hoisting apparatus may further include a capstan. The capstan may include a pulley engaged with the cable and adapted to move the cable by a corresponding rotation of the pulley. The hoisting apparatus may further include a tension sensor adapted to measure the tension of the cable. The hoisting apparatus may further include additional sensors adapted to measure process variables. The hoisting apparatus may further include a power pack adapted to drive the winch and the capstan. The hoisting apparatus may further include a winch control system adapted to control the power pack at least partially in response to a command signal, readings collected by the tension sensor, and the process variables such that the movements of the winch and capstan are coordinated.

The present disclosure also provides for an apparatus for controlling a winch or a winch and a capstan. The apparatus may include a winch control system adapted to control a power pack that is adapted to drive a winch or a winch and a capstan. The winch control system may be adapted to control the power pack at least partially in response to a command signal and readings collected by sensors.

The present disclosure also provides for a method. The method may include operatively coupling a winch control system to a power pack. The power pack may be adapted to drive a winch and a capstan. The method may also include receiving by the winch control system process variables detected by sensors from the winch, capstan, and the power pack. The method may also include sending a command signal to the power pack by the winch control system. The command signal may include instructions for the power pack to control the winch and capstan in a coordinated manner. The command signal may be based at least in part on the process variables. The method may also include controlling the movement of the winch and capstan by the power pack in response to the command signal.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
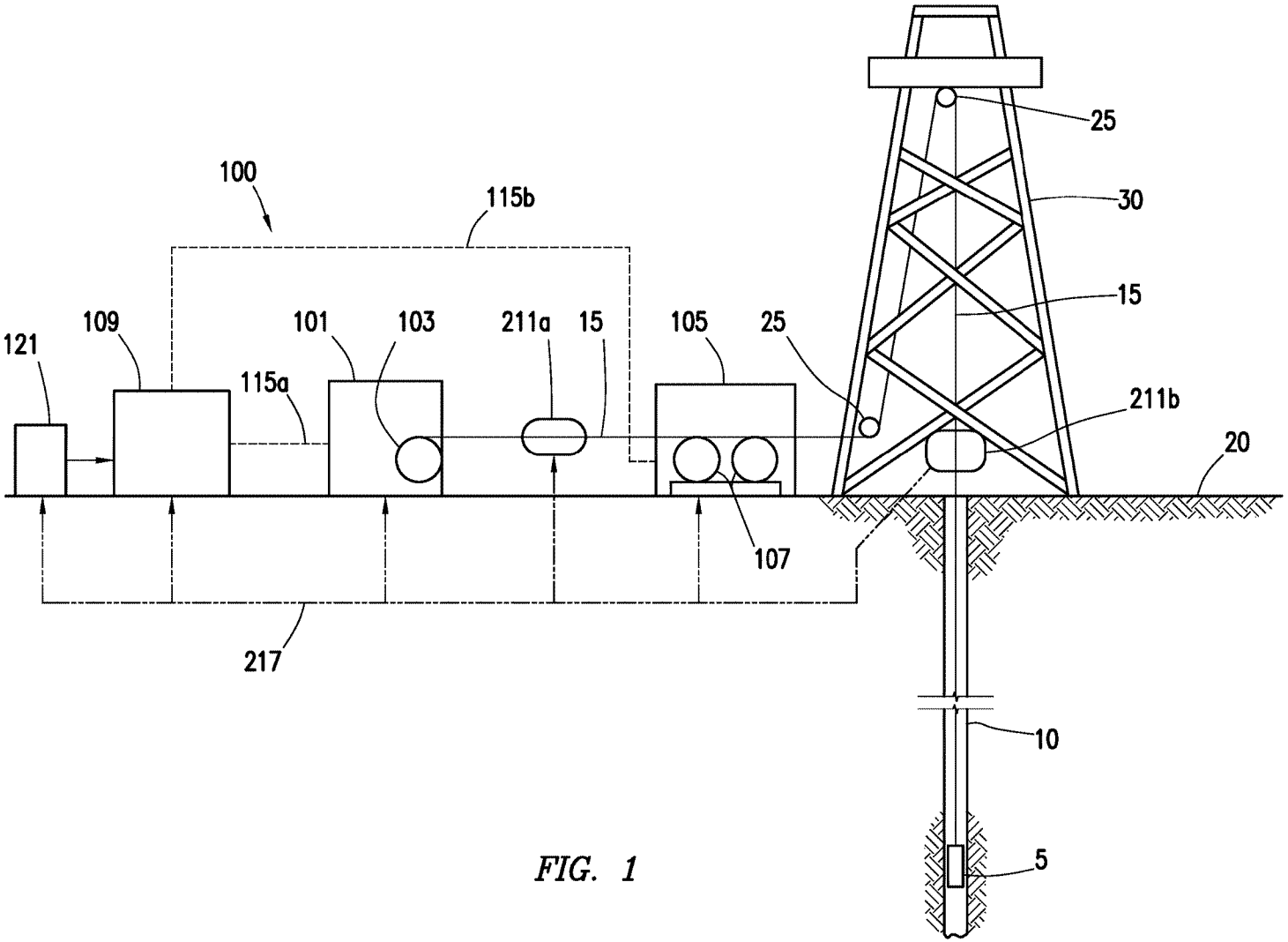
FIG. 1 depicts an overview of a wireline operation consistent with embodiments of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a wireline operation consistent with embodiments of this disclosure. As depicted, wireline tool 5 is lowered into wellbore 10 on cable 15. Cable 15 extends from wireline tool 5 through wellbore 10 to hoisting apparatus 100 at surface 20. Hoisting apparatus 100 may include winch 101. Winch 101 may include drum 103. Cable 15 may be coupled to drum 103 such that when drum 103 is rotated, cable 15 is coiled onto or uncoiled from drum 103 as understood in the art. In some embodiments, hoisting apparatus 100 may further include capstan 105. Capstan 105 may include one or more pulleys 107 adapted to apply force to cable 15 when rotated. In some embodiments, capstan 105 may be selectively removable from cable 15 depending on, for example and without limitation, torque requirements for the wireline operation being undertaken. In some embodiments, cable 15 may be coupled to hoisting apparatus 100 through one or more pulleys 25 adapted to change the direction of cable 15 to align with hoisting apparatus 100 at one end and wellbore 10 at the other as understood by one having ordinary skill in the art. In some embodiments, pulleys 25 may be included as a part of derrick 30.

Figure 2:
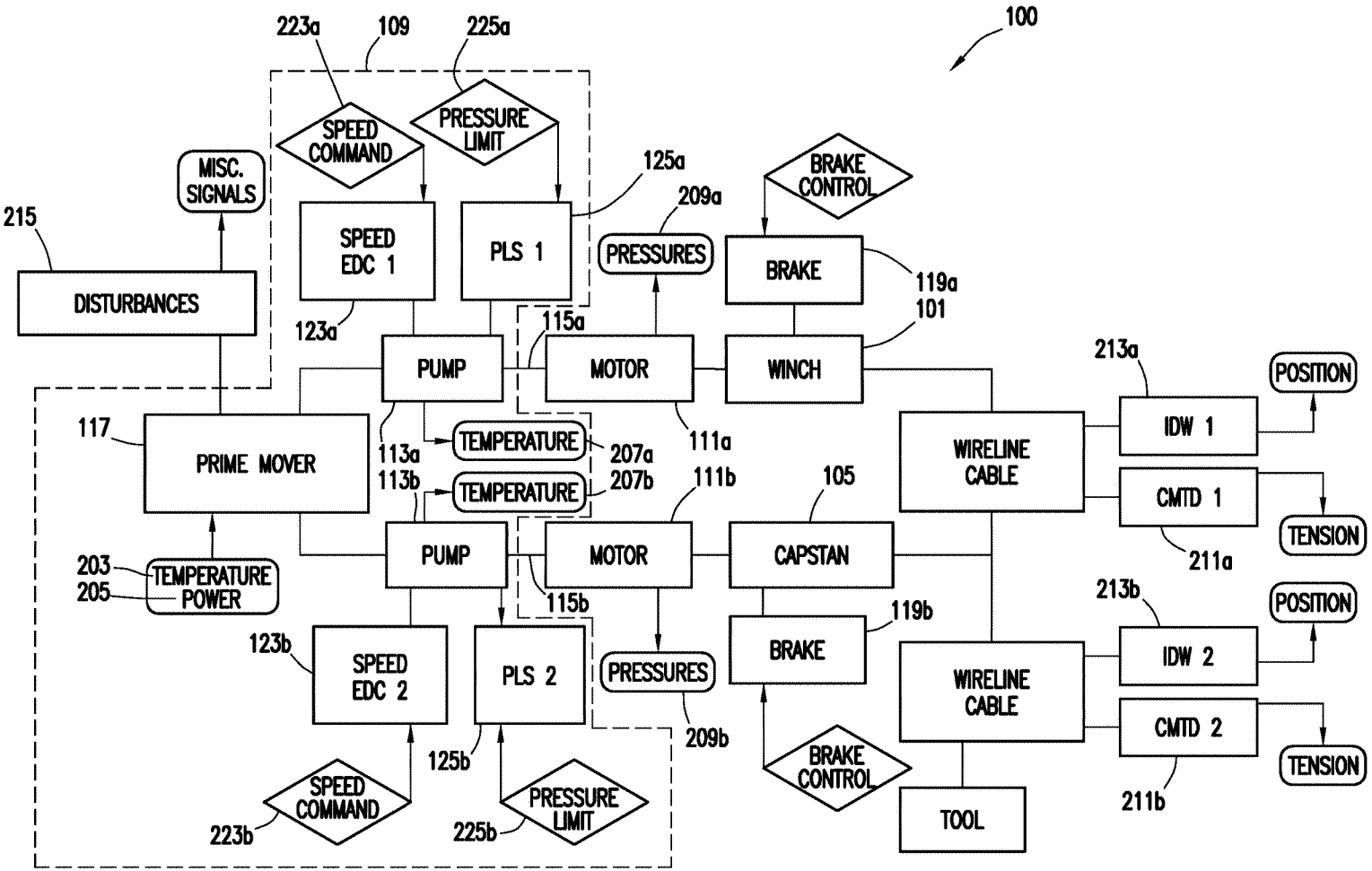
FIG. 2 depicts a process flow diagram of a winch control system consistent with embodiments of the present disclosure.

In some embodiments, winch 101 and capstan 105 may be powered by power pack 109. Power pack 109, as depicted in FIG. 2, may include one or more prime movers, pumps, generators, power busses, and/or motors. In some embodiments, a power pack 109 may be provided for each of winch 101 and capstan 105. In other embodiments, a single power pack 109 may be used to power both winch 101 and capstan 105.

In some embodiments, as depicted in FIG. 2, winch 101 and capstan 105 may be powered hydraulically. In some embodiments utilizing a hydraulic system, winch 101 may include hydraulic motor 111*a*. Hydraulic motor 111*a* may be coupled to hydraulic pump 113*a* within power pack 109 by hydraulic lines 115*a*. Hydraulic pump 113*a* may be powered by prime mover 117. In some embodiments, prime mover 117 may supply or generate power to hydraulic pump 113*a*, causing hydraulic pressure to move hydraulic motor 111*a* and thus move winch 101. In some embodiments, prime mover 117 may be an electric motor coupled to hydraulic pump 113*a*. In some embodiments, prime mover 117 may be a heat engine coupled to hydraulic pump 113*a*.

In some embodiments, capstan 105 may also include a hydraulic motor 111*b*. Hydraulic motor 111*b* may be coupled to hydraulic pump 113*b* within power pack 109 by hydraulic lines 115*b*. Hydraulic pump 113*b* may also be powered by prime mover 117. In some embodiments, hydraulic pump 113*b* may be powered by a second prime mover. In some embodiments, prime mover 117 may supply or generate power to hydraulic pump 113*b*, causing hydraulic pressure to move hydraulic motor 111*b* and thus move capstan 105.

Although described herein as utilizing hydraulic power, one having ordinary skill in the art with the benefit of this disclosure will understand that winch 101 and capstan 105 may be powered by any suitable power supply type including, for example and without limitation, a hydraulic or electric power supply, or by a mechanical power transfer linkage from power pack 109. In some embodiments, the mechanical power transfer linkage may include, for example and without limitation, a chain and sprocket connection or an elastic coupling.

In some embodiments, winch 101 may be coupled to brake 119*a*. In some embodiments, capstan 105 may be coupled to brake 119*b*. Brakes 119*a*, 119*b* may be positioned to slow or stop the movement of cable 15 by slowing or stopping the rotation of winch 101 and capstan 105.

In some embodiments, the movement of cable 15 may be controlled by winch control system 121 as depicted in FIG. 1. Winch control system 121 may, as understood in the art, be a programmable logic controller (PLC). Winch control system 121 may be adapted to control the rotation of winch 101 and capstan 105 by controlling the operation of hydraulic motors 111*a*, 111*b*. Winch control system 121 may vary the operation of one or more of hydraulic pumps 113*a*, 113*b*, prime mover 117, or brakes 119*a*, 119*b*. Winch control system 121 may operate to coordinate the movements of winch 101 and capstan 105 to, for example and without limitation, maintain a desired and generally stable tension in cable 15 therebetween. In some embodiments, winch control system 121 may be coupled to power pack 109 by one or more electrical connections. In some embodiments, winch control system 121 may control elements of power pack 109 via voltage or current control, or may be controlled by pulse-width modulation (PWM).

In one or more embodiments, winch control system 121 may be configured as a multiple input/multiple output controller (MIMO controller). Winch control system 121 may be adapted to simultaneously control and coordinate movements of winch 101 and capstan 105 through power pack 109. In one or more embodiments, winch control system 121 may have no segregation of subsystems. In one or more embodiments, winch control system 121 may include software adapted such that winch control system 121 is adapted to simultaneously monitor power pack 109 and control hydraulic flow, hydraulic pressure, and management of brakes 119*a* and 119*b* for both winch 101 and capstan 105. Thus, winch 101, capstan 105, and power pack 109 may thus be configured as a multiple input/multiple output system (MIMO system). In some embodiments, winch control system 121 may be adapted to couple to an existing hoisting apparatus 100.

In some embodiments, hoisting apparatus 100 may be operable with or without capstan 105. In some such embodiments, winch control system 121 and power pack 109 may be configured to operate winch 101 alone. In some embodiments, capstan 105 may be selectively added or removed from hoisting apparatus 100, in addition to physically coupling it to cable 15, by coupling to power pack 109 and winch control system 121, by, for example and without limitation, coupling hydraulic lines 115*b* to hydraulic pump 113*b* already positioned in power pack 109. In some embodiments, when capstan 105 is included, winch control system 121 may automatically coordinate the operation of winch 101 and capstan 105.

Figure 3:
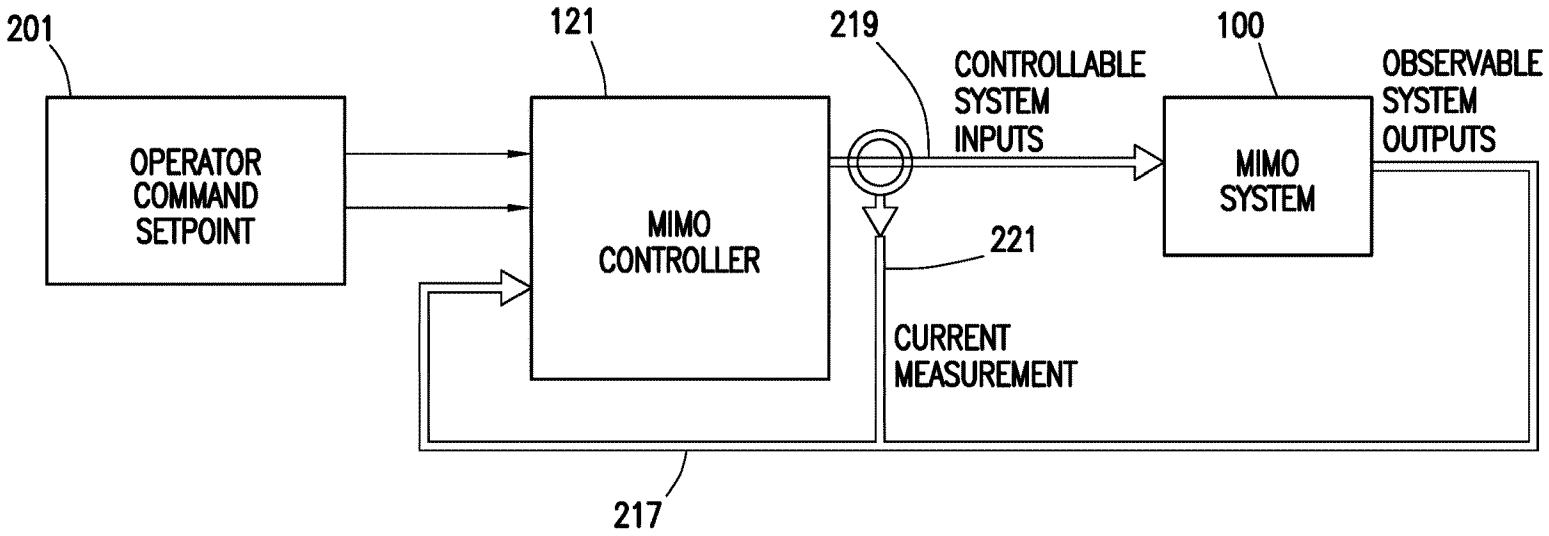
FIG. 3 depicts a schematic view of a winch control system consistent with embodiments of the present disclosure.

In some embodiments, winch control system 121, as depicted in FIG. 3, may be adapted to receive one or more command signals 201. Command signals 201 may include, for example and without limitation, move cable 15 one way, move cable 15 the other way, move cable 15 faster and pull hard, pull up on cable 15 to a desired tension, pull up on cable 15 to a threshold tension then stop, stop cable 15 outright, or any feasible combination of the above. In some embodiments, command signals 201 may also include a desired movement speed of cable 15, pressure limits for a hydraulic system, current limit for electrical systems, or temperature limits for prime mover 117 or hydraulic pumps 113*a*, 113*b*.

In some embodiments, winch control system 121 may be configured to operate winch 101 and capstan 105 utilizing one or more sensors adapted to provide feedback to winch control system 121. For example and without limitation, as depicted in FIG. 2, winch control system 121 may include sensors adapted to measure process variables such as prime mover oil temperature 203, prime mover power output 205, pump oil temperatures 207*a*, 207*b*, and hydraulic motor pressures 209*a*, 209*b*. In some embodiments, winch control system 121 may be coupled to sensors to measure information about cable 15. In some embodiments, a cable mounted tension device (CMTD) may be included to measure tension on cable 15. In some embodiments, a CMTD may be positioned on cable 15 between winch 101 and capstan 105 (CMTD 211*a*) and/or between capstan 105 and wellbore 10

(CMTD 211*b*). In some embodiments, an integrated depth wheel (IDW) may be included to measure the position of cable 15 with respect to the anchoring point of the IDW during operations. In some embodiments, an IDW may be positioned on cable 15 between winch 101 and capstan 105 (IDW 213*a*) and/or between capstan 105 and wellbore 10 (IDW 213*b*).

Additionally, as understood in the art, prime mover 117 may be used to power additional equipment including but not limited to spooling arms or electric generators. FIG. 2 depicts such additional loads as disturbances 215, as the time variant power required by this equipment may affect the stability of prime mover 117, and therefore the stability of hydraulic pumps 113*a*, 113*b* which drive winch 101 and capstan 105. For example and without limitation, disturbances 215 may include generator speed, generator power, wireline tool power consumption, generator hydraulic motor pressures, or the pre-charge pressure of any hydraulic lines.

In some embodiments, winch control system 121 may operate as a closed loop controller. As depicted in FIG. 3, winch control system 121 receives sensor outputs 217 as previously described as well as command signals 201. Winch control system 121 may provide system inputs 219 to hoisting apparatus 100. In some embodiments, winch control system 121 may receive current measurements 221 from system outputs 217 as well.

In some embodiments, sensor output 217 may be used in a closed loop control methodology to control the system inputs 219. As depicted in FIG. 2, system inputs 219 may include speed commands 223*a*, 223*b* fed to speed EDC modules 123*a*, 123*b* and pressure limits 225*a*, 225*b* for pressure limiting systems (PLS) 125*a*, 125*b* in order to control the speed of hydraulic pumps 113*a*, 113*b*, and thus the speed of winch 101 and capstan 105. As depicted in FIG. 3, sensor output 217 and current measurements 221 may be used by winch control system 121 as feedback signals to maintain desired operating conditions including, for example and without limitation, coordinated movement of winch 101 and capstan 105 with respect to cable tension and other parameters. In some embodiments, precompensation may also be utilized by winch control system 121. In some embodiments, integral action may be calculated and utilized by winch control system 121. In some embodiments, winch control system 121 may be designed according to specific performance criteria, including for example and without limitation, linear quadratic, linear quadratic Gaussian (LQR, LQG, or H2) or robust control (H-infinity) methods. In some embodiments, winch control system 121 may make use of linearization of a non-linear system around the operating point.

Figure 4:
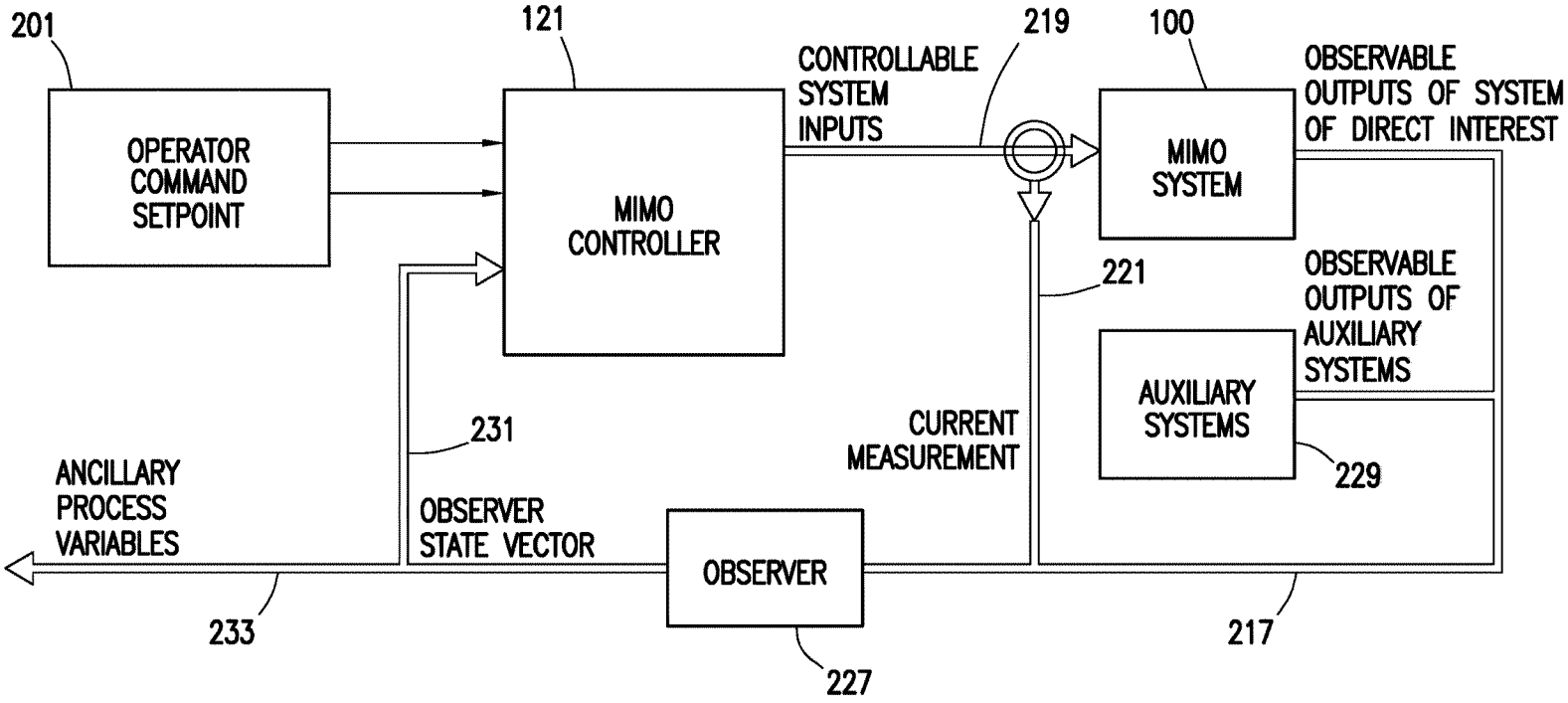
FIG. 4 depicts a schematic view of a winch control system consistent with embodiments of the present disclosure.

In some embodiments, as depicted in FIG. 4, winch control system 121 may further include state observer 227. As understood in the art, a state observer is a system that may provide an estimate of the state vector of a real system. In such embodiments, state observer 227 may receive data from hoist assembly 100 (including but not limited to the previously discussed sensor outputs 217) as well as from other auxiliary systems 229 as available. State observer 227 may utilize sensor outputs 217 and data from auxiliary systems 229 to adjust its internal system model to correspond with the feedback signals, thus computing the observer state vector. Auxiliary systems may include, for example and without limitation, spooling arms or electric generators coupled to power pack 109. State observer 227 may thus be able to estimate so called non-observable process data in calculating the state vector. In some embodiments, state observer 227 may thus provide the feedback input 231 to winch control system 121.

As an example not intended to limit the scope of this disclosure in any way, as cable 15 is extended, the effective diameter of drum 103 of winch 101 decreases as fewer wraps of cable 15 are beneath the currently unspooling portion of cable 15. State observer 227 may thus observe and calculate that the efficiency of hydraulic pump 113*a* has changed, i.e. the amount of cable 15 being unspooled for a given pump speed is no longer the same. State observer 227 may thus adjust its internal model to alter the control of hydraulic pump 113*a* by winch control system 121. In some embodiments, state observer 227 may, for example and without limitation, estimate the effective diameter of drum 103 based on: the amount of current going into EDC module 123*a*, cable speed measured at IDW 213*a* or 213*b*, or the hydraulic gears or ratios at which hydraulic pumps 113*a*, 113*b* are operating. Thus, by providing the state vector to winch control system 121, control of winch 101 and capstan 105 may be maintained despite changes in operating conditions. In some embodiments, winch control system 121 may thus be adaptive, utilizing on-the-fly non-linear parametric system identification and/or gain scheduling.

In some embodiments, state observer 227 may additionally output ancillary data 233 to the operator or to other systems, including but not limited to reliability metric calculations and prognostic health management systems. Ancillary data 233 may include, for example and without limitation, the values of one or more of the sensors or the state vector.

Although described specifically with respect to a wireline operation with a downhole tool in a wellbore, one having ordinary skill in the art with the benefit of this disclosure will understand that winch control system 121 may be used with any winch-capstan installation without deviating from the scope of this disclosure.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A hoisting apparatus comprising:

a winch, the winch including a drum adapted to extend or retract a cable wrapped therearound;

a capstan, the capstan including one or more pulleys engaged with the cable and adapted to move the cable by a corresponding rotation of the pulleys;

a tension sensor adapted to measure the tension of the cable;

one or more sensors adapted to measure one or more process variables;

a power pack adapted to drive the winch and the capstan; and a winch control system adapted to control the power pack at least partially in response to command signals, readings collected by the tension sensor, and the one or more process variables such that the movements of the winch and capstan are coordinated;

wherein the tension sensor is positioned between the winch and the capstan.

2. The apparatus of claim 1, wherein the winch control system operates as a closed loop controller in response to one or more process variables including the tension of the cable.

3. The apparatus of claim 1, wherein the command signals comprise one or more of a desired speed and direction to move the cable, a desired cable tension, a threshold tension for the cable, a stop command, a pressure limit for a hydraulic system, a current limit for an electrical system, or a temperature limit for a component of the power pack, winch, or capstan.

4. The apparatus of claim 1, wherein the winch and capstan are coordinated such that the tension of the cable extending from the winch to the capstan is generally stable.

5. The apparatus of claim 1, wherein the tension sensor is a cable mounted tension device.

6. The apparatus of claim 1, wherein the capstan is selectively removable and the power pack and winch control system are adapted to operate the winch with the capstan disconnected.

7. The apparatus of claim 1, wherein the winch and capstan are each driven by the power pack by an electric connection, hydraulic connection, or by a mechanical linkage.

8. The apparatus of claim 1, wherein the winch and capstan are each driven by a hydraulic motor, each hydraulic motor powered by a hydraulic pump in the power pack, the hydraulic motors coupled to the hydraulic pumps by one or more hydraulic lines, each hydraulic pump powered by a prime mover in the power pack.

9. The apparatus of claim 8, wherein a single prime mover is used to drive the winch and the capstan.

10. The apparatus of claim 8, wherein the winch control system is further adapted to control the power pack at least partially in response to readings collected by one or more additional sensors wherein the additional sensors comprise one or more of additional tension sensors, a cable position measuring device, a pressure sensor coupled to a hydraulic pump, a speed controller coupled to a hydraulic pump, or a hydraulic oil temperature sensor.

11. The apparatus of claim 8, wherein the power pack comprises a single prime mover, the prime mover adapted to power each hydraulic pump.

12. The apparatus of claim 8, wherein the process variables comprise one or more of prime mover speed, prime mover torque, prime mover instantaneous power, generator speed, generator power, wireline tool power consumption, generator hydraulic motor pressures, pre-charge pressure, pump speeds, pump pressures, cable tension, or hydraulic oil temperature.

13. The apparatus of claim 12, further comprising a state observer, the state observer adapted to determine a state vector, the state vector calculated at least partially in response to the observed process variables, the winch control system adapted to use the state vector to coordinate movement of the winch and capstan.

14. The apparatus of claim 13, wherein the state observer is adapted to further receive additional data comprising auxiliary system loads.

15. The apparatus of claim 14, wherein auxiliary system loads comprise at least one of a generator, spooling arm, or downhole tool power draw.

16. The apparatus of claim 8, wherein the winch control system is adapted to control winch speed, capstan speed, winch hydraulic pressure, capstan hydraulic pressure, a brake coupled to the winch, or a brake coupled to the capstan.

17. The apparatus of claim 16, wherein the winch control system provides output signals to the power pack in the form of voltage or PWM signals.

18. The apparatus of claim 17, further comprising a current sensor adapted to measure the current of the output signals of the winch control system, wherein the current detected by the current sensor is used to at least partially determine the movements of the winch and capstan.

* * * * *